US005241801A

United States Patent [19]

Nelson

[11] Patent Number: 5,241,801

[45] Date of Patent: Sep. 7, 1993

[54] CONTAINER LID MOUNTING AND SEALING SYSTEM

[75] Inventor: James L. Nelson, Temple City, Calif.

[73] Assignee: Highland Plastics, Inc., Pasadena, Calif.

[21] Appl. No.: 938,067

[22] Filed: Aug. 31, 1992

[51] Int. Cl.[5] ..... B65B 57/02; B65B 7/28

[52] U.S. Cl. ..... 53/64; 53/313; 53/329.2

[58] Field of Search ..... 53/64, 505, 506, 313, 53/314, 315, 316, 329.2, 478, 477

[56] References Cited

U.S. PATENT DOCUMENTS

| | | | |
|---|---|---|---|
| 2,352,764 | 7/1944 | Bell | 53/313 X |
| 3,460,312 | 8/1969 | Stover | 53/64 |
| 3,620,989 | 12/1971 | Reinecke | 53/64 |
| 3,977,161 | 8/1976 | Faber et al. | 53/313 |
| 4,095,390 | 6/1978 | Knudsen | 53/314 X |

*Primary Examiner*—James F. Coan
*Attorney, Agent, or Firm*—David O'Reilly

[57] ABSTRACT

An automated lid mounting and sealing apparatus for containers comprised of a conveyor belt, a lid dispenser to feed lids one at a time as a container passes by on the conveyor belt; a lid mounting press belt, a lid closure section for closing a tear band on the lid and a lid sealing section for sealing a tamper resistant device around the lid. The lid dispenser drops a lid into a chute to be withdrawn as each container passes the dispenser. The container with the lid then passes beneath a press belt that snaps the lid in place on the container. A tear strip band on the lid is then folded under the lid and rim by a closure section. In an optional embodiment the closure section is not used and a plastic shrink band seal is placed on top of the container around the lid. Heat is then applied in a sealing section as the container is rotated to secure the tamper resistant protective device around the lid and container.

20 Claims, 5 Drawing Sheets

CONTAINER LID MOUNTING AND SEALING SYSTEM

FIELD OF THE INVENTION

This invention relates to lid mounting and sealing systems and more particularly relates to a machine for feeding, mounting and sealing lids on packaging containers.

BACKGROUND OF THE INVENTION

Tampering with packaging containers and particularly food containers has led to the development and increasingly frequent use of tamper resistant lids for such containers. It is now imperative that all food containers have some type of tamper protection.

There are various types of tamper resistant protection. Some are in the form of seals over lids and caps while other types of protection is in the form of tear off seals beneath lids. These devices are intended to provide evidence of tampering to the user. Any damage to the protective seals is a warning not to consume the product inside the container.

For cups, tubs or bowl like containers for foodstuffs various tamper evident protection devices are used. One popular method is to add a shrink band plastic seal around the periphery of a lid. This type of seal makes it difficult to get the lid off beneath the seal with some evidence of damage to the shrink band of plastic. This seal is a band of plastic film that shrinks when heated. Any tearing, stretching or damage to the plastic seal will provide evidence of tampering and provide a warning by being evident to the user.

Another popular and widely used method of providing a protective seal is with some form of tear off band around the periphery of a lid. To gain access to the contents of the container requires tearing the band off the lid or container. The tear band essentially prevents removal of the lid without stripping away the band. Any attempt to remove the lid to gain access to the contents without removing the tear band will usually result in visible damage to the tear band. This damage protects the user by providing evidence of tampering.

These tamper evident protection devices are under constant development and improvement. One such improved protection device is disclosed and described in U.S. Pat. No. 5,115,934 of James A. Nelson the same inventor as the system disclosed herein. The device of this patent is a substantial improvement of tamper evident tear bands. Most tear bands provide protection but can be defeated. The device of this patent provides a tear strip melt band that has deformable links and a locking system that is extremely difficult to defeat after it is installed.

The lid is mounted on a container and the locking tear strip folded down around a flange on the periphery of a container. This causes deformable links joining tabs around the tear band to bulge. Heating the tear band causes the links to melt and deform into the space between the tabs securely locking the lid on the container. The deformable links so securely lock the lid on the container that it is nearly impossible to remove the lid without breaking one or more of the links providing clear evidence of tampering.

All these devices, of course, slow up production of food packaging. The lids with the tamper evident seals, be it plastic film shrink bands or tear bands must be carefully installed to provide the required protection but also to prevent damage to the seal which might mistakenly appear to be evidence of tampering. In some cases, the lid or shrink band plastic is manually installed which is a disadvantage.

Another disadvantage of the shrink band seals is the heat applied to shrink the plastic shrink band seal tightly around the periphery of the lid. Shrink band seals are pre-formed and manually placed on the container after the container is filled and the lid put on. The filled container with the shrink band seal is then passed through an oven on a conveyor belt to heat and shrink the plastic seal on the container. A disadvantage of this method is that as a result the entire container and its contents are heated. In many cases the heat can have a detrimental effect on the contents such as decreasing shelf life or at the very least change the flavor or character of the contents.

Therefore it is one object of the present invention to completely automate lid dispensing, mounting and sealing.

Yet another object of the invention is to provide a lid dispensing, mounting and sealing apparatus that avoids heating the contents of the containers.

Still another object of the present invention is to fully automate the lid installation and sealing after containers are filled.

Another object of the invention is to provide a unique automated lid dispensing apparatus.

Yet another object of the invention is to provide a lid dispensing, mounting and sealing apparatus that is adjustable to accommodate different size containers.

Still another object of the present invention is to provide a lid sealing apparatus for tamper resistant containers that use either tear bands or shrink band seals.

BRIEF DESCRIPTION OF THE INVENTION

The purpose of the present invention is to provide a lid dispensing, mounting and sealing apparatus for use for tamper resistant containers.

The above purposes are achieved by a machine that includes an automatic feed lid dispensing device for dispensing lids to containers filled with a product traveling along a conveyor belt. As a filled container passes by the lid dispenser, the front edge of the container catches the inside groove of the lid pulling the lid from the dispenser. The container with the lid is then passed beneath a overhead belt traveling at the same speed as the conveyor. The belt presses the lid onto the container snapping it into position for the first stage of closing.

As one lid is pulled from the dispenser another lid is dropped into position by a sensing system that senses a lid being removed and activates a synchronous drive system that rotates several serrated posts holding a stack of lids resting on a shelf at the end of the post. The serrations on the posts hold the stack of lids and release only one lid from the bottom when it is activated to rotate one revolution by a synchronous drive motor. The released lid falls onto a ledge closing off a portion of an entry hole to tilt the lid into a nearly vertical position allowing it to fall into an angled chute where it is held in position by a lid locating mechanism.

After the lid is pressed onto the container, the lid and container are passed through a lid closing section. This section is made up of a vertically oriented motor driven belt opposite a back bar. As a capped container enters this section, a moving belt grabs the outer edge of the lid and starts to pull it forward causing the lid and container to rotate. The area between the belt and backup bar is constructed to narrow during this section causing the tear strip on a container lid to fold under and latch into position.

The container with the capped and latched lid then passes to a heating and sealing section. As the container enters this section, one side ramps up a stationary strip while the other side of the container remains on the conveyor belt. The stationary plate causes the container to slowly rotate at about half the speed of the conveyor. A teflon guide bar maintains the position of the filled container on the stationary plate. As the container rotates, heat is applied from manifolds that deliver a ribbon of hot air while the capped container is rotated through the heating and sealing section. This deforms links on the tear strip of the container sealing the lid on the container without heating the contents.

The same apparatus can be used for mounting shrink wrapped tamper resistant bands on capped containers. The container passes through the lid dispensing section as before and lids are mounted and pressed on the container. The back bar in the section for closing tear strip containers is opened or removed to allow the container to pass through the closure section. At this time plastic film shrink band seals are placed around the periphery of the container lids. The containers then pass into the heating and sealing section as before. However, in this case a deflector plate is added to the manifold on one side of the sealing section to deflect air downward on top of the container while on the other side the manifold delivers a ribbon of hot air beneath the lid to the side of the container. The heat is such that the shrink band seal shrinks, securely fastening the lid on the container.

The above and other features of this invention will be fully understood from the following detailed description and the accompanying drawings, in which:

DETAILED DESCRIPTION OF THE INVENTION

Figure 1:
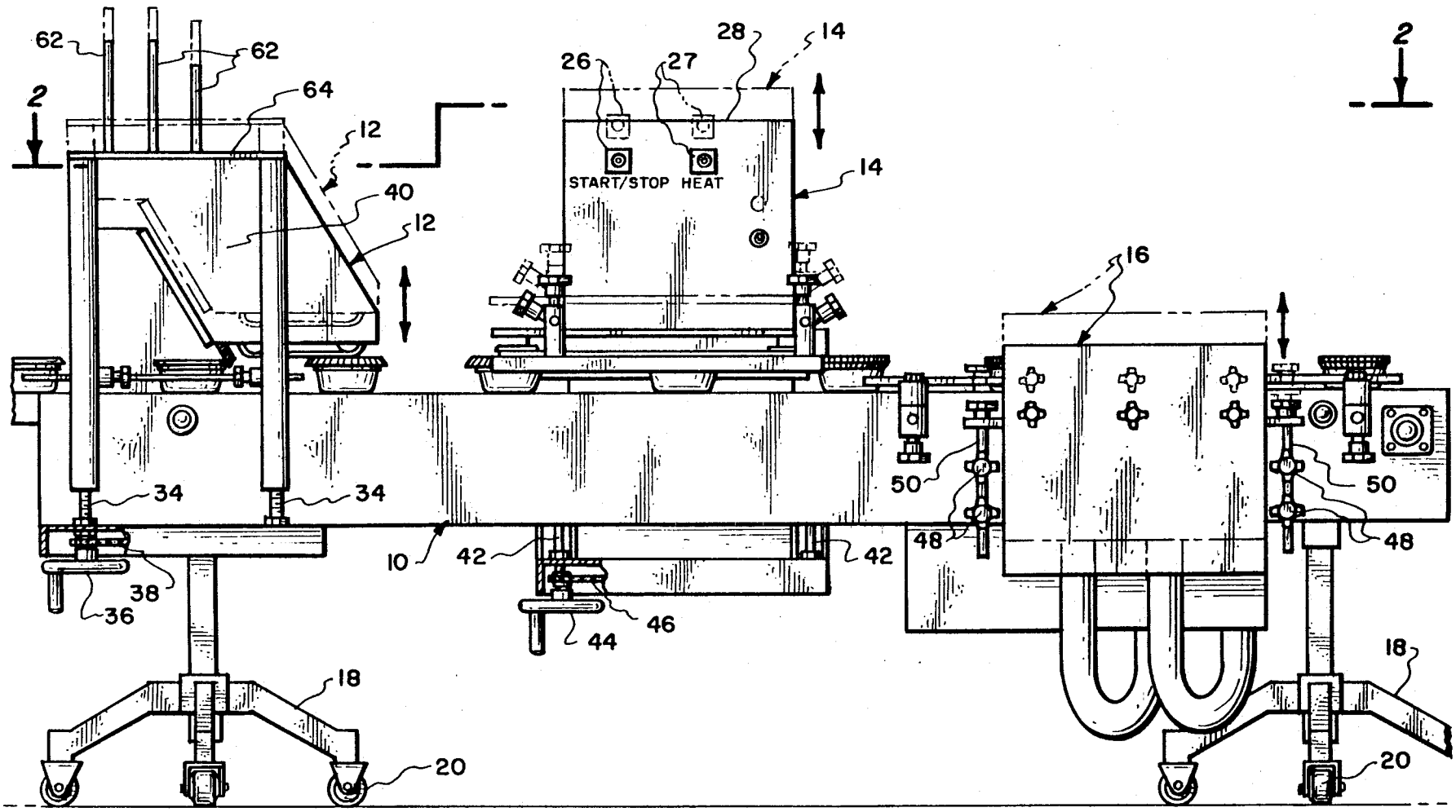
FIG. 1 is a side elevation of the lid dispensing, mounting and sealing apparatus constructed according to the invention.

A fully automated lid dispensing, mounting and sealing apparatus is shown generally in FIG. 1 and is comprised of conveyor system 10, lid dispensing section 12, lid closing section and control center 14 and heating and sealing section 16. The lid dispensing device 12, closing section 14, and heating and sealing section 16, are adjustable to accommodate different size containers as will be described in greater detail hereinafter.

Figure 8:
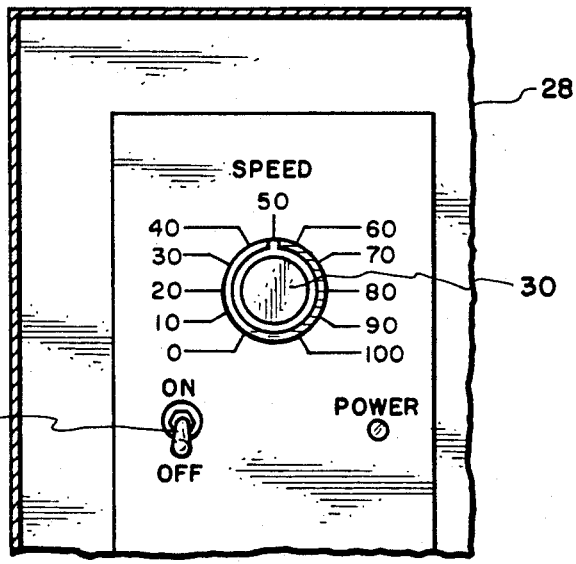
FIG. 8 is a partial sectional view illustrating the speed control taken at 8—8 of FIG. 2.

Conveyor section 10 is mounted on pedestals 18 having rollers 20 and handles 11 which allow the lid mounting and sealing apparatus to be easily moved. Conveyor system has a frame 22 supporting conveyor belt 24 driven by electrical motor (not shown). The conveyor system and heat is turned on and off by switches 26, 27 respectively in control center 28 that includes a speed control 30 (FIG. 8) to vary the speed of the conveyor.

The lid dispensing device 12, closing section 14 and heating and sealing sections 16 are adjustable for different size containers. Lid dispensing device 12 is mounted on worm screws 34 and is raised by crank 36 connected to worm screws by chain 38. Chain 38 passes around four worm screws 34, two on each side, and raises and lowers box 40 containing the lid dispensing mechanism. This allows the lid mounting and sealing system to accommodate different size containers. Operating crank 36 raises lid dispensing system 12 for larger containers.

Likewise, lid closing section 14 is mounted on worm screws 42 to be raised and lowered by crank 44 operating chain 46 passing around gears on worm screws 42. Operation of crank 44 raises and lowers lid closing section 14 as illustrated in phantom.

Heating and sealing sections 16 are also vertically adjustable by releasing clamping knob 48 clamping rods 50 supporting the heating and sealing section allowing it to be vertically adjusted. Similar clamping knobs 48 on the opposite side of conveyor 10 allow adjustment of the other heating section.

In addition to being adjustable vertically, the lid closing section 14 and heating and sealing section 16 are also horizontally adjustable. This allows slight adjustment for larger containers. Clamping knobs 52 allow each heating and sealing section 16 to be moved toward or away from conveyor system 10 on rods 54.

Lid closing section 14 also includes a back up bar 56 for pressing the periphery of a lid to close the tear strip beneath the rim of the container. Back up bar 56 is mounted on rods 58 secured by clamping knobs 60. Back up bar 56 can be horizontally adjusted toward or away form conveyor belt 24 or completely removed.

Figure 2:
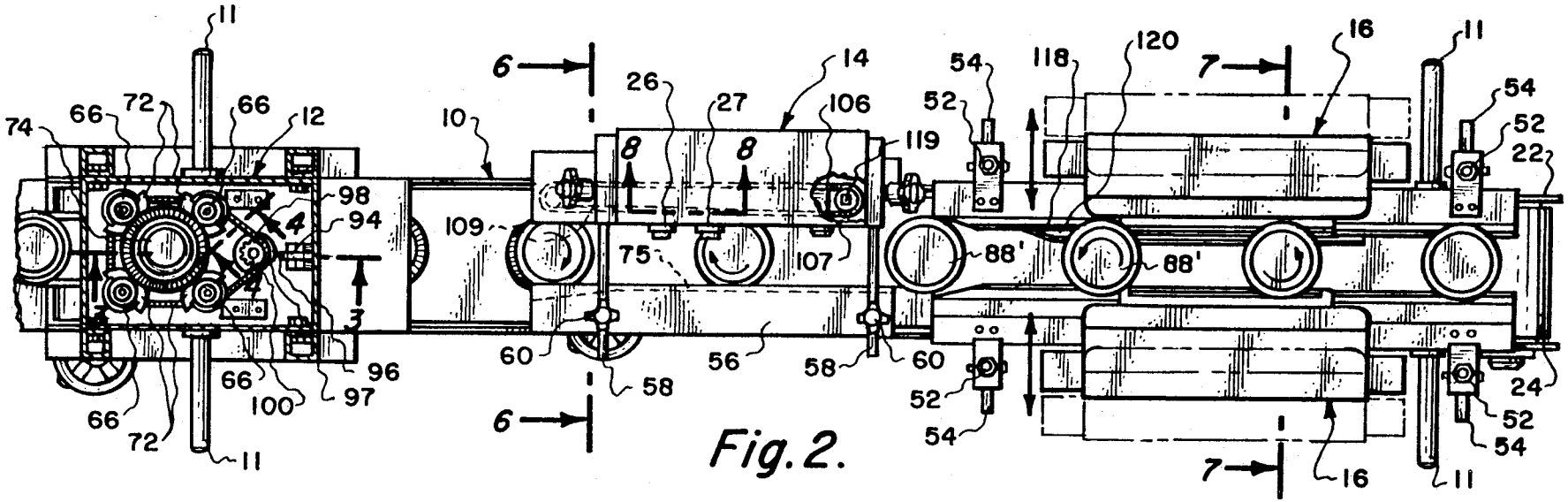
FIG. 2 is a top view of the lid dispensing, mounting and sealing apparatus in partial section taken at 2—2 of FIG. 1.
Figure 4:
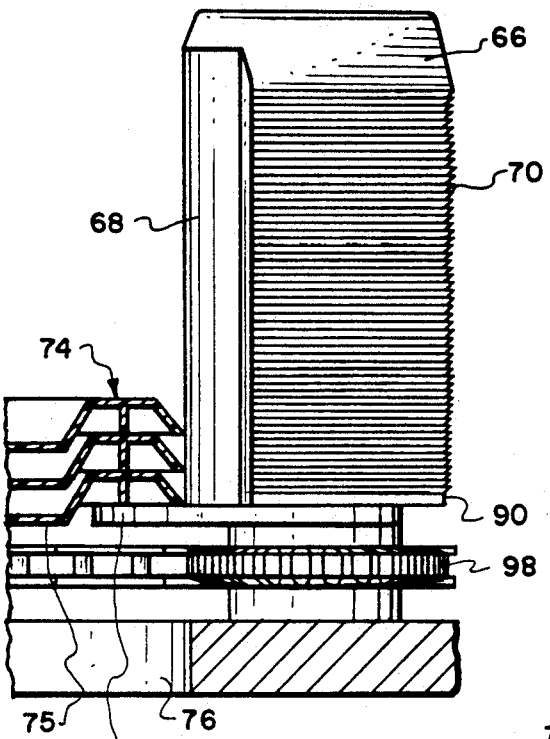
FIG. 4 is a sectional view of the lid dispensing device taken at 4—4 of FIG. 2.
Figure 5:
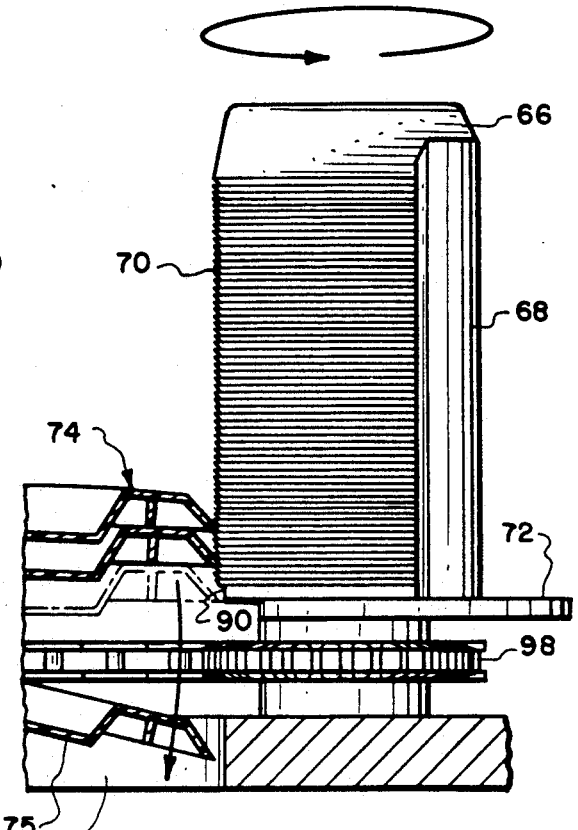
FIG. 5 is a sectional view similar to FIG. 4 illustrating the release of a lid.

Lid dispensing device 12 allows lids to be dispensed down a chute to a locating mechanism as shown in FIGS. 1-5. An inventory of lids are stacked between lid guide bars 62 mounted on cover 64 to guide lids between lid retaining serrated posts 66. The design of serrated posts 66 provide a cam-like shape that creates an open and closed effect when rotated with the to changing diameters. The smallest diameter is created by a set back or off set 68 that extends around one half or slightly more of the diameter of serrated posts 66. The remaining diameter of the post is undercut with serrations 70 that provide a chiseled sawtooth shape forming upward pointing edges as shown in FIGS. 4 and 5. At the lower end of the post 66 are blades 72 forming an arc of approximately 180° that provide a shelf for the stack of lids 74 as illustrated in FIG. 2. The arc of blades 72 is about equal to the angle of the off set 68 on serrated posts 66 so that when blades 72 are not holding the stack of lids 74 serrations 70 will.

Each lid released from the stack 74 falls into hole 76 partially obstructed by ledge 78 tilting lid 75 to a nearly vertical position as it drops into chute 80. Each released lid as it drops into chute 80 drops into a locative mechanism comprised of plate 82 and weight 84. Weight 84 provides a gravity held retaining door or gate 85 for lid 75' properly positioning it to catch the edge 86 of container 88.

A single lid is sequentially released by rotating the four serrated posts 66 one revolution. While there are four posts shown, more or less could be used as desired. A single lid 75 is released by rotating serrated posts 66 one revolution as shown in FIGS. 4 and 5. At rest, the stack of lids 74 rest on blades 72 forming a shelf. As serrated posts 66 are rotated blades 72 release the stack of lids 74 and bottom lid 75 drops because of detent 90 at the lower end of post 66. Continued rotation of serrated posts 66 back to the rest position allows stack 74 to drop onto the shelf formed by blades 72. Thus the bottom lid is sequentially released by rotation of serrated posts 66 which then stops allowing the stack to drop onto blades 72.

Sequential stepped rotation of serrated posts 66 is controlled by photo detecting light conducting rod 92, proximity sensor 94 and sectored cam 96 driven by electric motor 95. When lid 75' is pulled from gravity held gate 85 a photodetector 92 that initiates rotation of serrated posts 66 through chain 98 and gear 100 driven by electric motor 95. Once rotation is begun proximity sensor adjacent sectored cam 96 continues the rotation until gap 97 is encountered causing serrated posts 66 to stop after a single revolution allowing the stack of lids 74 to drop onto the shelf formed by blades 72.

Thus the sequence is, detect the removal of a lid from gate 85 by photodetecting sensor 92, starting the motor to rotate serrated posts 66, detecting the proximity of sector cam 97 by proximity detector 94 to continue the rotation, and stopping rotation of serrated posts 66 when proximity sensor 94 senses gap 97 in sectored cam 96. This stepping sequence occurs each time a lid is removed from gate 85 by catching the edge 86 of container 88 and withdrawn. When serrated posts 66 are rotated one half revolution serrations 70 engage edges of the stack of lids 74 slightly compressing them and preventing them from dropping. When offset portion 68 of post 66 is reached, stack of lids 74 drops onto a shelf formed by blades 72 and the lid dispensing device is ready for dispensing another lid.

As container 88 with lid 75' moves forward on conveyor belt 24 they are captured beneath belt 102 and rollers 104 traveling at the same speed as conveyor belt 24 below. Belt 102 being parallel to conveyor 24 presses on the lid snapping it onto container 88 completing the first stage of closing.

Container 88 continues to travel down conveyor 24 with lid 75' until it encounters lid closing section 14. Closing section 14 is comprised of motor driven horizontal belt 106 moving in the same direction as container 88 and conveyor 24 and backup bar 56 having groove 57 engaging the periphery of lid 75'. As container 88 enters this section moving belt 106, shown in partial serction, driven by electric motor 119 grabs outer edge 110 of lid 75' and starts to pull it forward causing the lid and container 88 to begin to spin. Groove 57 and backup bar 56 is constructed to narrow the space between backup bar and vertical belt 106 as container 88 continues to spin and move forward on conveyor belt 24. As the space becomes tighter the restriction increases on the outer edge of the lid and the tear strip 110 begins to fold beneath the rim of container 88 and latch into position. A backing plate 107 behind vertical moving belt 106 (shown in the breakaway partial section) cut at a 10° angle indicated at 109 (FIG. 6) is provided so that an initial section of the belt has less support than the last section of the belt. This allows closing section 14 to have a primary and secondary closing effect. The first and primary closing effect is to begin to fold tear strip 110 beneath lid 75' and rim of container 88 while the secondary closing effect where the 10° angle on backing plate 107 ends latches the tear strip in place.

Figure 6:
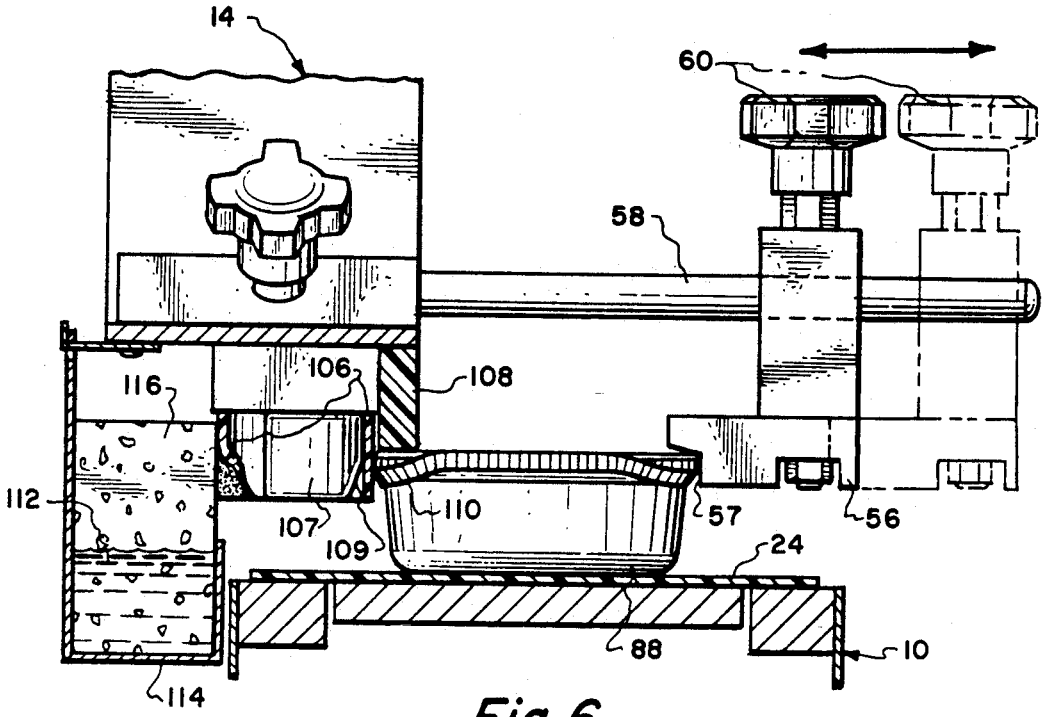
FIG. 6 is a sectional view of the lid closing section constructed according to the invention taken at 6—6 of FIG. 2.

To facilitate rotation of cup 88 with lids 75' horizontal rotating belt 106 is lightly lubricated as shown in FIG. 6. A lubricating material 112 such as water in container 114 lubricates sponge 116 in contact with belt 106 to lightly lubricate the belt and facilitate the spin or rotation of cup 88.

Figure 7:
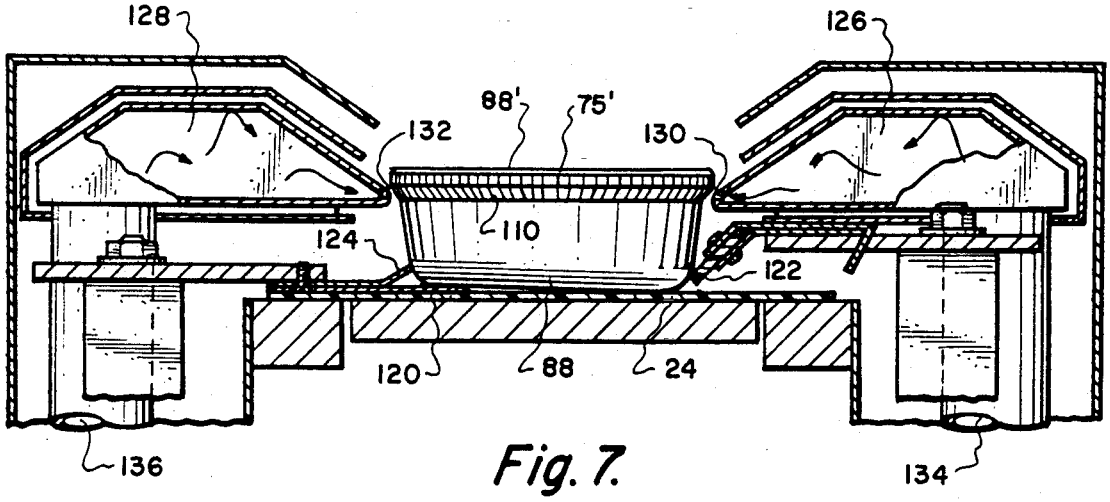
FIG. 7 is a sectional view of the heating and lid sealing section taken at 7—7 of FIG. 2.

Capped container 88' then passes into heating and sealing sections 16 as illustrated in FIG. 7. As capped container 88' enters this section, one side of the container "ramps up" beveled section 118 of thin stationary plate 120 while the opposite side of cup 88 continues to rest on conveyor belt 24. This causes capped container 88' to "walk" along conveyor belt 24 and slowly rotate at about half the speed of the conveyor. As capped container 88 continues to turn Teflon guide bar 122 forces capped Container 88 against guide bar 122 keeping the container located in the proper position.

While capped container 88' rotates through heating and healing section, heat is applied on each side from heating manifolds 126 and 128. Each manifold 126 and 128 is designed to fit just under the edge of lid 75' and deliver a ribbon of hot air at approximately 500° F. from thin slits 130 and 132 running the full length of manifolds 126 and 128. The length of manifolds 126 and 128 and thin slits 130 and 132 are determined by the diameter of the bottom of container 88 and should be long enough to complete at least one full revolution of the container. Thus the length of manifolds 126 and 128 and thin slits 130 and 132 is approximately equal to or slightly longer than the circumference of the bottom of container 88.

Heat is supplied through ducts 134 and 136 to thin slits 130 and 132 along melt band tear Strip section 110 for a predetermined number of revolutions. Heat applied to tear strip 110 from thin slits 130 and 132 allows deformable links to melt into the space between tabs as shown and described in U.S. Pat. No. 5,115,934 completely sealing lid 75' on container 88. The finished product then continues down conveyor 24 for boxing and shipping.

Figure 9:
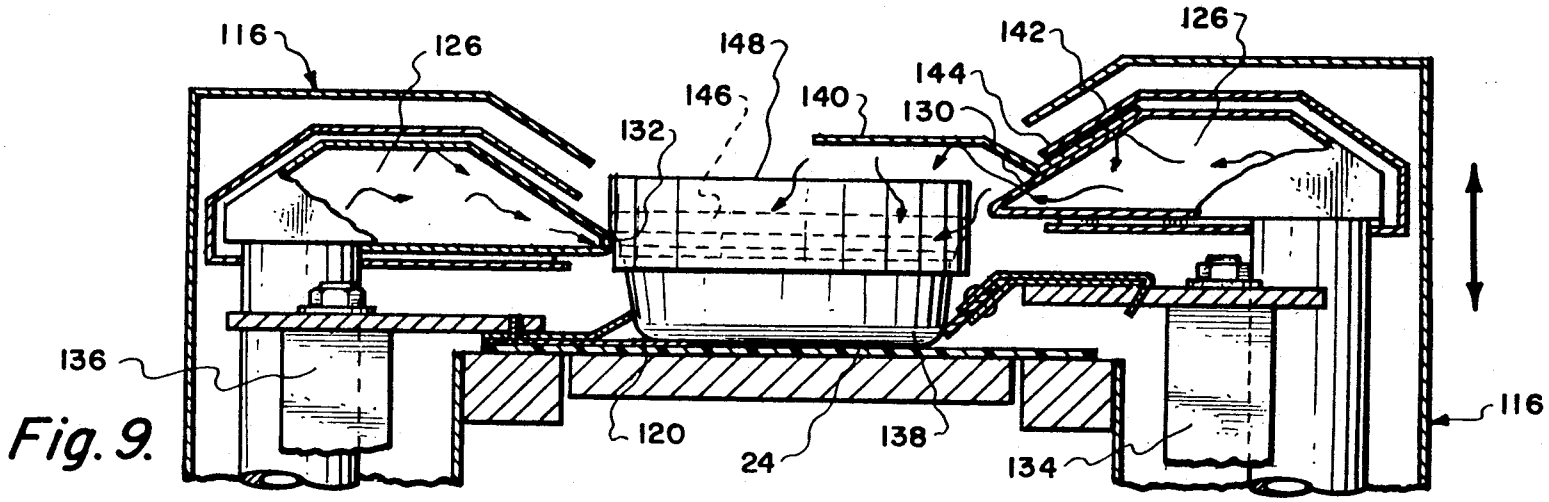
FIG. 9 is a sectional view of the heating and sealing section similar to FIG. 7 illustrating the use of the sealing section for shrink band seals.
Figure 3:
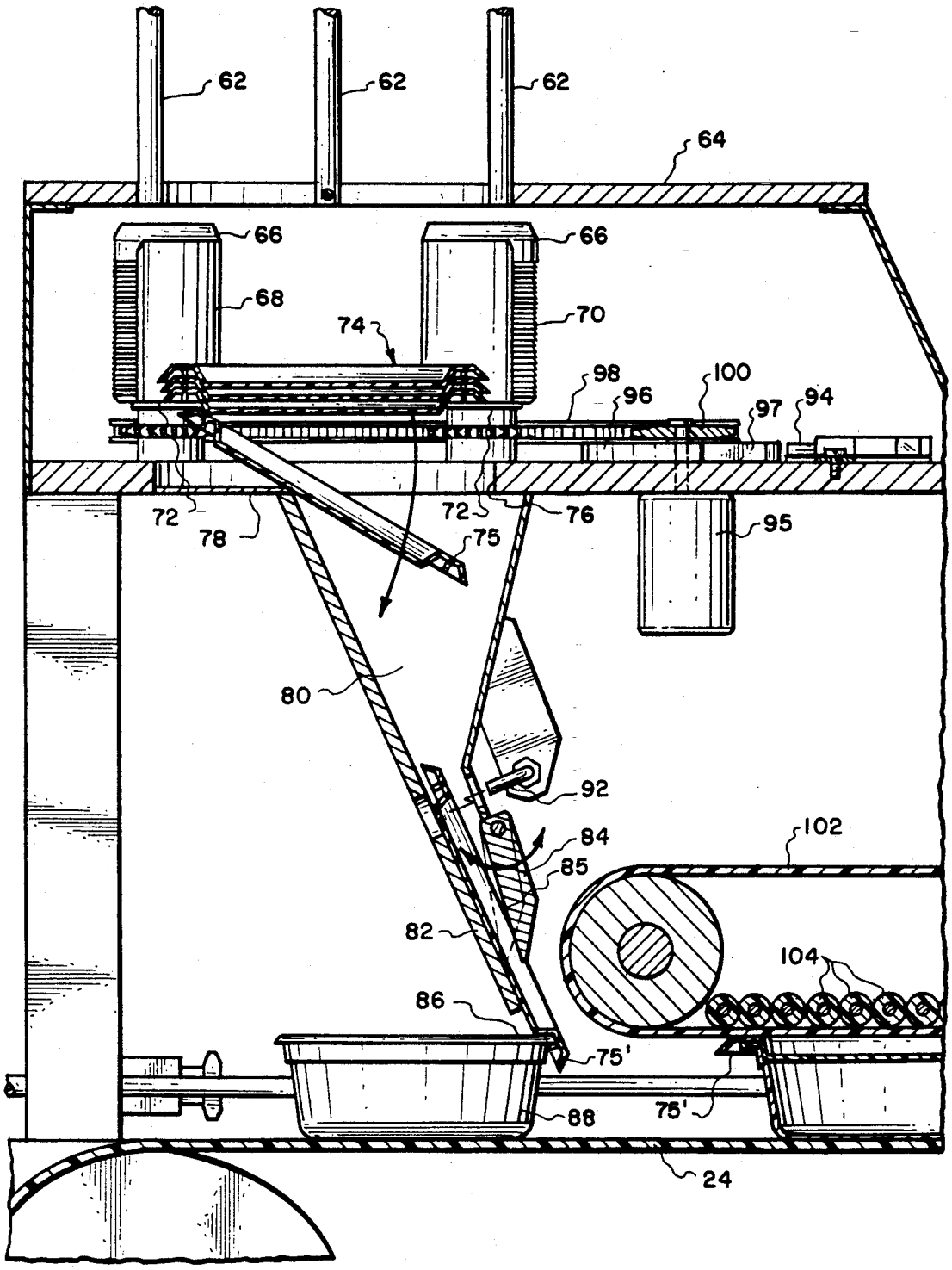
FIG. 3 is a sectional view of the lid dispensing apparatus taken at 3—3 of FIG. 2.

The system can also be used for capping containers that use the shrink band type of tamper resistant protection. The modification to the system to use the lid mounting and sealing apparatus is illustrated in FIG. 9. One of heat sealing sections 116 is raised as described previously to apply heat to the top of container 138. Deflector 140 is inserted beneath guard 142 and is held in place by one or more dimples 144. Deflector 140 is the same length as manifold 126 and thin slit 130. Heat applied through slit 130 is deflected downward by deflector 140 toward the top of cup 138. On the other side, heat is applied through thin slit 132 beneath lid 146 as container 138 moves along conveyor 24. Again thin metal strip 120 causes container 138 to slowly rotate as it passes along conveyor belt 24 heating plastic shrink band 148 placed on container 138. Plastic shrink band 148 shrinks around the periphery of container 138 and lid 146 completely sealing the container to provide a tamper evident seal.

The lid dispensing, mounting, and sealing system operates as follows. Lids are dispensed from lid dispensing device 12 down chute 80 to a locating mechanism comprised of plate 82 and gravity weighted door 84 to be located in gate 85. As a filled container 88 is carried by conveyor 24 to lid dispenser 12 front edge 86 of container 88 catches an inside groove of lid 75'. The weight and momentum of filled container 88 will pull lid 75' out of locating mechanism simultaneously letting gravity weighted door 84 open.

As lid 75' and container 88 travel forward on conveyor 24 they are captured by overhead belt 102 traveling at the same speed as conveyor belt 24. Container and lid pass through parallel belt system 102 beneath rollers 104 causing lid 75' to snap onto container 88 for the first stage of closing.

At the same time fiber optically controlled detecting device 92 observes lid 75' being removed from lid locating mechanism or gate 85 activating electric drive motor 95 which rotates the four lid supporting serrated posts 66 one revolution. The special design of lid retaining serrated posts causes stacked lids 74 to remain in the stack releasing only one lid 75 from the bottom. The remaining stack of lids are compressed between serrations 70 on posts 66 until the revolution is completed allowing the stack to drop onto support shelf formed by blades 72. As lid 75 falls into opening 76, ledge 78 partly obstructing the opening deflects lid 75 from a horizontal position to a nearly vertical position dropping it into chute 80. Lid 75 can now slide down chute 80 into lid locating mechanism or gate 85 where it is ready for the next container. Each capped container 88' comes out of the dispensing section and continues down conveyor 24 to the spin and lid closing section 14.

Capped container 88' moves on conveyor 24 between motor driven closure belt 106 and groove 57 in back up bar 56. As capped container 88' enters the closure section moving belt 106 grabs the outer edge of lid 75' and starts to pull it forward causing capped container 88' to begin to spin. As capped container 88' travels through closing section 14 the space between moving belt 106, belt backing plate 107, and groove 57 of backup bar 56 narrows and becomes tighter against the outer edge of lid 75' which begins to fold tear strip 110 beneath the lid and rim of cup 88 latching it into position. Backing support plate 107 behind moving belt 106 cut at a 10° angle as indicated at 109 provides less support for the first half of travel by belt 106 but more support over the last part of the belt which causes closing section 14 to have primary and secondary closing effects described previously.

Once tear strip 110 is closed and latched around the periphery of cup 88 closed capped container 88' travels down conveyor 24 to heating and sealing sections 16. As closed container 88' enters this section, the bottom on one side of cup 88 ramps up thin stationary plate 120, while the opposite side remains on moving conveyor belt 24. This principle makes the container "walk" along and rotate at about half the speed of conveyor belt 24. A teflon bar keeps the container located in the proper position. While capped container 88' is rotating through this section, heat is applied from two manifolds, one on each side, to the sensitive melt band tear strip section of lid 75'.

Each manifold is designed to fit just under the lid and deliver a ribbon of hot air at approximately 500° F. from thin slits 130 and 132 running the full length of each manifold. The length of the manifold is selected to heat the lid through at least one full revolution. Thus the melt band tear strip section is exposed to the heat from the thin slits of the manifolds 126 and 128 for a predetermined number of revolutions. This causes the deformable links to melt into the gap between adjacent tabs completely sealing lid 75' on container 88. The finished product continues down the conveyor for boxing and shipping.

Thus there has been disclosed a lid dispensing, mounting, heating and sealing apparatus for mounting and sealing tamper resistant lids on containers. The system provides a unique lid dispenser that dispenses lids one at a time using serrated posts to hold the stack during the release of each lid. A closing section rotates the container and lid as a tamper evident tear strip is folded under the periphery of the lid and container locking the lid on the container. The tamper evident strip is then heated in a heating and sealing section to lock the lid on the container. The heating and healing section are also constructed for modification with a simple deflector plate to be used with heat shrinked plastic bands that provide tamper evident container seals. The deflector plate added to one of the heating manifold deflects heat to the top of the container to shrink the plastic shrink band seal around the lid and container.

This invention is not to be limited by the embodiment shown in the drawings and described in the description which is given by way of example and not of limitation, but only in accordance with the scope of the appended claims.

What is claimed is:

1. A lid dispensing, mounting and sealing system comprising:

lid dispensing means for sequentially releasing lids one at a time;

conveyor means conveying lids past said lid dispensing means to receive each lid dispensed;

sensing means in said lid dispensing means sensing the removal of each lid and initiating the release of another lid;

mounting means for securely mounting said dispensed lid on said container;

heat sealing means for heating and sealing a tamper resistant means to seal said lid on said container.

2. The system according to claim 1 wherein said lid dispensing means comprises; means for stacking a plurality of lids; means for sequentially releasing a single lid; and means for holding said stack of a plurality of lids while a single lid is released.

3. The system according to claim 2 in which said means for holding a stack of lids while a lid is released comprises; a plurality of posts, said posts having a plurality of serrations around a portion of each post; a sectional blade mounted at the bottom of each post forming a shelf, a portion of each of said posts having a set back diameter; said sectional blades being at the end of said set back portion of said posts; whereby said stack of lids are supported by said shelf during a portion of the rotation of said plurality of posts and are supported by said serrations during the remainder of each revolution of said posts.

4. The system according to claim 3 wherein each post has a recess adjacent each blade forming said shelf whereby a single lid is released from said stack when said plurality of posts are rotated.

5. The system according to claim 1 in which said lid dispenser has a chute for receiving each released lid; a ledge at an opening to said chute for tilting each lid to a vertical position; and positioning means in said chute for positioning a lid to be placed on a container as it passes.

6. The system according to claim 2 in which said means for holding a stack of lids comprises; a plurality of guides; a plurality of rotatable posts; and a shelf formed at the end of said plurality of posts.

7. The system according to claim 6 in which said plurality of rotatable posts have a serrated section and a smaller diameter smooth offset section; said serrated section having a plurality of serrations constructed to hold said stack of lids while a single lid is being released from the bottom of said stack.

8. The system according to claim 7 in which said shelf is formed by a plurality of sectional blades mounted at the bottom of said posts; said sectional blades being at the bottom of said off set smooth section of said posts.

9. The system according to claim 8 including a recess at the bottom of said posts for releasing the bottom lid of said stack when said posts and sectional blades are rotated.

10. The system according to claim 9 in which said positioning means comprises a gate at the end of said chute; said gate being formed by a gravity operated weight holding a lid partially extended from said chute whereby a lid is removed from said lid dispensing means by the rim of a container catching the edge of said lid in said gate.

11. The system according to claim 10 in which said sensing means comprises a photoconductor in said chute sensing the removal of a lid; and a proximity detector for detecting the rotation of said posts; whereby when a lid is removed said posts are turned one revolution to release another lid.

12. The system according to claim 1 including lid closure means for closing a tear strip band on said lid after it is mounted on a container; said lid closure means comprising a belt engaging a side of said lid to rotate said lid and container; and means for squeezing said tear band beneath the periphery of said lid.

13. The system according to claim 12 including lubricating means lubricating said belt to facilitate rotation of said container with said lid during closure.

14. The system according to claim 1 in which said heating means comprises a pair of manifolds on either side of said conveyor belt for heating the edge of said lid; and means for slowly rotating said lid and container as it passes by said heating means.

15. The system according to claim 14 in which said means for slowly rotating said lid and container comprises a thin stationary plate engaging one side of the bottom of said container while the other side rests on said conveyor belt.

16. The system according to claim 15 in which said pair of manifolds have a length equal to at least the circumference of the bottom of said container.

17. The system according to claim 14 including means for adjusting the position of at least one of said manifolds; a deflector plate for attachment to one of said manifolds to deflect heat downward; whereby a plastic shrink band may be sealed around the lid of a container.

18. A lid dispenser for dispensing lids to be mounted on a container comprising;

lid stack holding means comprised of guides, a plurality of rotatable posts, and shelf means at the end of said posts;

means for rotating said rotatable posts to release a lid one at a time;

a chute for receiving each lid as it is released;

lid positioning means for positioning a lid to be placed on a passing container; and sensing means for sensing removal of a lid and releasing the next lid.

19. The lid dispenser according to claim 18 in which said rotatable posts comprise; a post having a serrated section around a portion of the diameter and an off set smooth portion around the remaining diameter of said posts; said serrations constructed and arranged to hold a stack of lids while one lid is released from the bottom.

20. The system according to the lid dispenser according to claim 19 in which said sensing means comprises; a photodetector in said chute for detecting the removal of a lid; and a proximity sensor to stop rotation of said posts after a lid is released.

* * * * *